US005687648A

United States Patent [19]

Puschnerat et al.

[11] Patent Number: 5,687,648

[45] Date of Patent: Nov. 18, 1997

[54] DEVICE FOR FASTENING A RUBBER BLANKET UNIT TO A BLANKET CYLINDER

[75] Inventors: Helmut Puschnerat, Wachenheim; Peter Schröder, Hessheim, both of Germany

[73] Assignee: Koenig & Bauer-Albert Aktiengesellschaft, Wurzburg, Germany

[21] Appl. No.: 642,442

[22] Filed: May 3, 1996

[30] Foreign Application Priority Data

May 5, 1995 [DE] Germany ..... 295 07 523 U
Nov. 6, 1995 [DE] Germany ..... 195 41 249.4

[51] Int. Cl.[6] ..... B41F 1/28

[52] U.S. Cl. ..... 101/415.1; 101/409

[58] Field of Search ..... 101/415.1, 409

[56] References Cited

U.S. PATENT DOCUMENTS

| | | | |
|---|---|---|---|
| 2,135,150 | 11/1938 | Schmidt | 101/415.1 |
| 2,525,003 | 10/1950 | Smith | 156/154 |
| 4,870,901 | 10/1989 | Norkus | 101/415.1 |
| 5,010,818 | 4/1991 | Wallschlaeger, Sr. | 101/415.1 |
| 5,062,363 | 11/1991 | Reichel | 101/415.1 |

FOREIGN PATENT DOCUMENTS

| | | | |
|---|---|---|---|
| 35 38 308 | 2/1994 | Germany . | |
| 43 07 320 | 7/1994 | Germany . | |
| 43 20 464 | 12/1994 | Germany . | |
| 1 566 389 | 4/1980 | United Kingdom . | |
| 2167011 | 5/1986 | United Kingdom | 101/415.1 |

*Primary Examiner*—Edgar S. Burr
*Assistant Examiner*—Leslie Grohusky
*Attorney, Agent, or Firm*—Jones, Tullar & Cooper, P.C.

[57] ABSTRACT

A device for fastening a rubber blanket unit to a blanket cylinder utilizes a rubber blanket secured to the surface of a support plate which is provided with beveled ends. These ends are insertable into a narrow slit in the cylinder and are held in the slit by pressure elements. The beveled support plate end lateral surfaces are in contact with each other.

1 Claim, 3 Drawing Sheets

DEVICE FOR FASTENING A RUBBER BLANKET UNIT TO A BLANKET CYLINDER

FIELD OF THE INVENTION

The present invention is directed generally to a device for fastening a rubber blanket unit to a blanket cylinder. More particularly, the present invention is directed to a device for fastening a rubber blanket unit to a blanket cylinder in a rotary printing press. Most specifically, the present invention is directed to a device for fastening a rubber blanket unit to a blanket cylinder by use of a blanket holding device disposed on the blanket cylinder. A narrow, axially extending, generally radially inwardly directed slit is provided on the blanket cylinder. A pivot lever or spindle is rotatably positioned in a bore in the blanket cylinder generally adjacent the radial inner end of this slit. End legs of the support plate of the blanket unit are inserted in the slit and are held by pressure elements that are carried on the rotatable spindle.

DESCRIPTION OF THE PRIOR ART

In the field of rotary printing, it is often necessary to secure various plates and other flexible cylinder covers to the outer, peripheral surfaces of various ones of the rotatable cylinders in the printing press. These cylinder covers should be securable and should also be removable in as uncomplicated fashion as possible, while ensuring that their attachment to the surface of the cylinder will be secure and reliable. The securement device should also take up as little of the peripheral surface area of the cylinder as possible and should not compromise the structural integrity of the cylinder.

One prior art device that is usable to secure a rubber blanket unit to a cylinder in a rotary printing press is disclosed in German Patent Publication DE 43 07 320 C1. The blanket unit consists of a rubber blanket which is attached to an underlying support plate that is formed having beveled or angled legs. These legs, which are not covered by, or coated with, the rubber material, are inserted into a slot which is formed on the surface of the blanket cylinder.

A limitation of this prior art device is that the legs of the blanket unit cannot be secured in this cylinder slot. The non-secured ends of the rubber blanket are pulled out of the slot by adhesive forces which occur between the printing cylinder and the blanket cylinder because of the adhesive force of the ink. This occurs particularly strongly at the end of printing of each sheet or page. The legs of the rubber blanket unit are subsequently again pressed into the slot when the two cylinders roll off on each other. This leads to a continual, periodically repeated movement of the two legs of the blanket unit in the slot. Since this movement is stronger at the end of a printing cycle than at the start of a printing cycle, a relative movement between the two legs occurs. This movement of the legs in the slot as well as with respect to each other leads to wear of the legs, which can progress to the point that the legs break off. Furthermore, because the legs are pulled out, the rubber blanket unit rests unsupported on the cylinder at least part of the time and is therefore subjected to changing bending stresses, which can lead to the permanent breaking of the support plate.

Another prior art device which is usable to clamp the beveled ends of a rubber blanket unit to a blanket cylinder is depicted in German Patent Publication DE 43 20 464 A1. This device consists of a resilient clamping body which acts radially in relation to the cylinder. This resilient clamping body presses a beveled leg, that is coated with a rubber blanket, and an uncoated leg of a support plate against a sidewall of a cylinder trough.

A disadvantage of this prior device is that the clamping body is made of one piece and extends in the axial direction along the entire length of the slot. It is thus not possible to compensate for manufacturing tolerances in, for example, the width or position of the slot, the thickness of the legs of the rubber blanket unit in the direction of the slot, or of the clamping body. This can result in the rubber blanket unit being clamped at only one or two points, because of which extreme local stresses occur, which can result in tearing of the rubber blanket unit or the support plate.

A stretching of the rubber blanket unit, that occurs because of a kneading effect, cannot be absorbed by the clamped ends, because the friction between the coated leg and the uncoated leg, which is increased by the rubber blanket, prevents the insertion at the trailing leg. This results in the rubber blanket unit resting unsupported on the cylinder. This can lead to a break in the support plate because of continuous bending stresses. It is furthermore disadvantageous that the clamping body cannot be removed, which makes changing of the rubber blanket unit more difficult.

In U.S. Pat. No. 2,525,003 there is shown another prior art device which is usable to fasten a rubber blanket unit, consisting of a rubber blanket and a support plate, to a cylinder. The rubber blanket unit is provided with two beveled edges. On each of these beveled edges a beveled leg of the support plate is located so that it projects past the ends of the rubber blanket. The rubber blanket on the support plate terminates in the area of a bevel bounding the legs. These two beveled edges are inserted into a cylinder slot having a width of approximately 6.5 mm. A wedge is positioned between the opposing faces of the two legs of the blanket unit. This wedge serves to press one leg of the rubber blanket against a lateral face of the slot. The rubber blanket unit is frictionally held in the slot by use of this wedge type holding device.

The German Patent Publication DE 35 38 308 C2 discloses a device that is usable to mount a rubber blanket on a blanket cylinder of a web-fed rotary printing press. In this prior device, the rubber blanket is secured to a dimensionally stable support plate and the two combine to form the rubber blanket unit. A beveled leg of the support plate extends past the rubber blanket at the trailing end of the rubber blanket unit. The beveled leg at the leading end of the support plate is coated with the rubber blanket. These two dissimilar ends of the rubber blanket unit can be inserted into a slot of the blanket cylinder in a manner such that the trailing end of the rubber blanket, which ends in a trailing blanket edge, has this edge approximately in contact with the angled end portion of the leading end of the rubber blanket unit.

A limitation of this prior device is that, although the width of the cylinder channels or slot has been considerably reduced from the width of the slot depicted in the prior art U.S. Pat. No. 2,525,003, it is still too large. This large width cylinder slot or channel still is so large that it cannot effectively reduce vibrations which are caused by cylinder bounce due to the non-supporting width of this cylinder conduit or channel. The usable circumferential space of the cylinder is also limited by the prior art device slot width and the stability of the cylinder is impaired. Clamping forces are also needed to hold the rubber blanket unit. This prior art unit is structured in accordance with the belief that is widely held in the printing industry that the adhesion of an unencumbered front end of a rubber blanket to a support plate is apt to be problematic.

It will be seen that a need exists for an assembly which will overcome these limitations of the prior art devices. The device for fastening a rubber blanket unit to a blanket cylinder in accordance with the present invention provides such a device and is a significant improvement over the prior art devices.

SUMMARY OF THE INVENTION

It is an object of the present invention to provide a device for fastening a rubber blanket unit to a blanket cylinder.

Another object of the present invention is to provide a device for fastening a rubber blanket unit to a blanket cylinder of a rotary printing press.

A further object of the present invention is to provide a device for fastening a rubber blanket unit to a blanket cylinder by use of a blanket holding device disposed on the blanket cylinder.

Still another object of the present invention is to provide a device for fastening a rubber blanket unit in a narrow, axially extending slit in a blanket cylinder of a rotary printing press.

Yet another object of the present invention is to provide a rubber blanket unit fastening device which substantially eliminates vibrations resutling from cylinder bounce and in which no force is required to clamp the rubber blanket.

As will be discussed in detail in the description of the preferred embodiment which is presented subsequently, the device for fastening a rubber blanket unit to a blanket cylinder of a rotary printing press in accordance with the present invention utilizes a rubber blanket unit which consists of a rubber blanket that is secured to an underlying support plate which is provided with leading and trailing angled or beveled end legs. The beveled end legs of the rubber blanket unit are not coated with the rubber blanket. The rubber blanket has edges that essentially abut each other when the blanket unit is secured in place on the cylinder. The cylinder itself is provided with an axially extending, generally radially directed slit which is sized so that it will receive the beveled leading and trailing end legs of the support plate of the rubber blanket unit. Lateral outer faces of these support plate end legs are in contact with each other when the end legs are inserted into the cylinder slit. A plurality of pressure elements are disposed axially along the slit. Each of these pressure elements is spring biased into engagement with an inner surface of one of the end legs of the support plate. The spring forces of these pressure elements are such that the two adjacent end legs of the support plate can be securely clamped between a lateral face of the cylinder slit and the pressure cams.

A particular advantage of the present invention resides in the stability which is provided to the blanket cylinder by the use of an extremely narrow width cylinder slit. Since the slit is so narrow and since it is effectively filled by the beveled end legs of the support plate, there is essentially no cylinder bounce or wobble which typically occurs when one of the cylinders in rolling contact with another one of the cylinders is not supported by the second cylinder due to the existence of a relatively wide cylinder slot or channel. This stability of the cylinder contributes to improved print quality.

The beveled or angled end legs of the blanket unit support plate are held in the narrow cylinder slit without the imposition of a great deal of force. This makes the clamping of the rubber blanket unit much more easily accomplished. Also in an advantageous manner, since the cylinder slit is so narrow, the usable cylinder circumference is also increased.

It has been determined during testing that the front edge of the rubber blanket does not separate or peel away from the underlying support plate during press operation. This is contrary to the widely held belief in the printing industry and allows the rubber blanket unit of the present invention to be secured by using a very narrow cylinder slit.

The rubber blanket portion of the rubber blanket unit in accordance with the present invention does not stretch because kneading of the blanket is prevented. The two ends of the rubber blanket essentially abut each other. Soiling and the cleaning effort associated therewith are reduced. Replacement of the rubber blanket unit in accordance with the present invention can be accomplished rapidly, and in a simple manner.

The blanket cylinder for use in the present invention can be manufactured quickly and easily. It is much more reliable and durable than prior art devices have been.

The device for fastening a rubber blanket unit to a blanket cylinder in accordance with the present invention overcomes the limitations of the prior art. It is a substantial advance in the art.

BRIEF DESCRIPTION OF THE DRAWINGS

While the novel features of the device for fastening a rubber blanket unit to a blanket cylinder in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
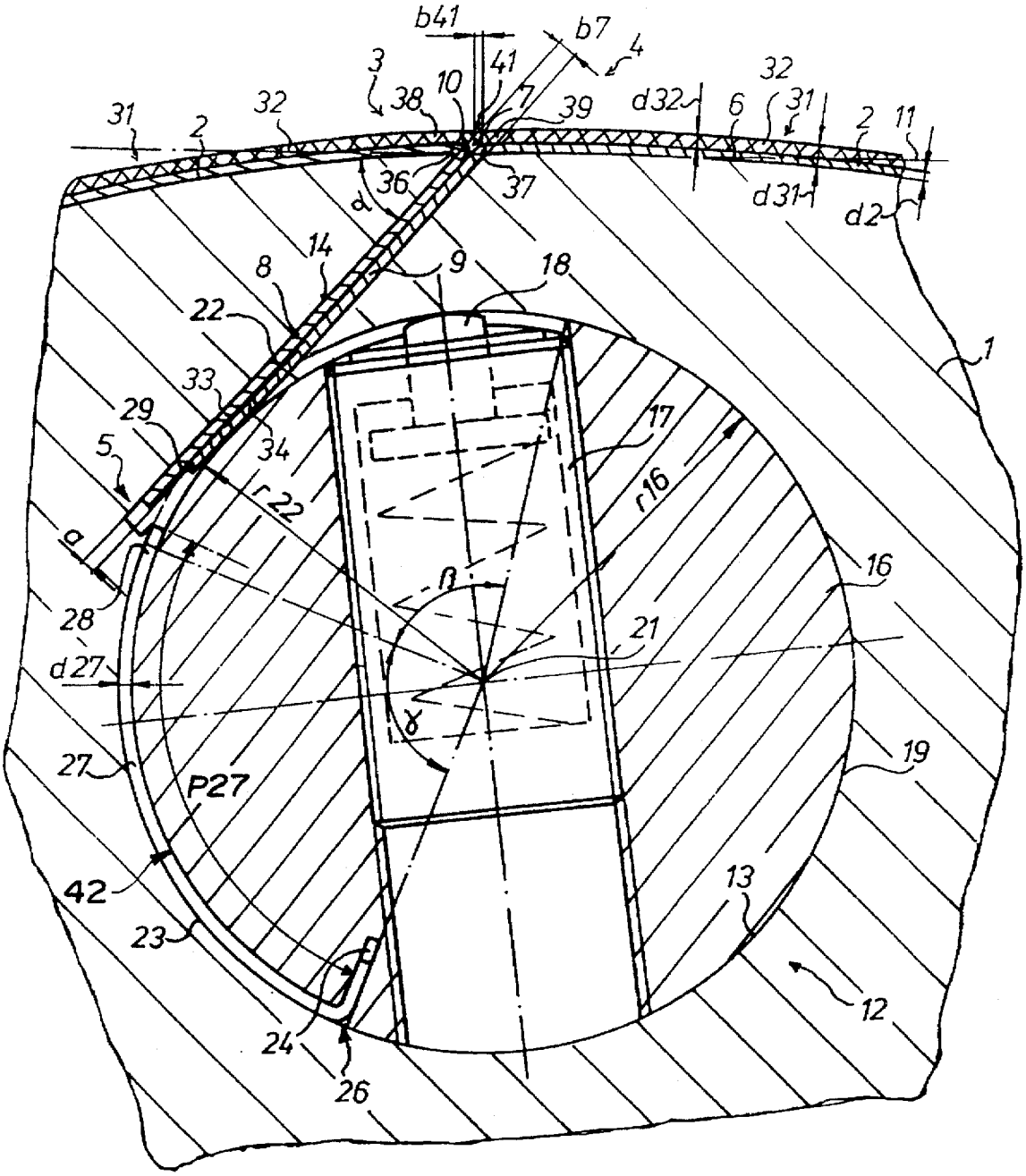
FIG. 1 is a schematic cross-sectional view of a portion of a blanket cylinder and showing the device for fastening a rubber blanket unit in the insertion process in accordance with the present invention.
Figure 2:
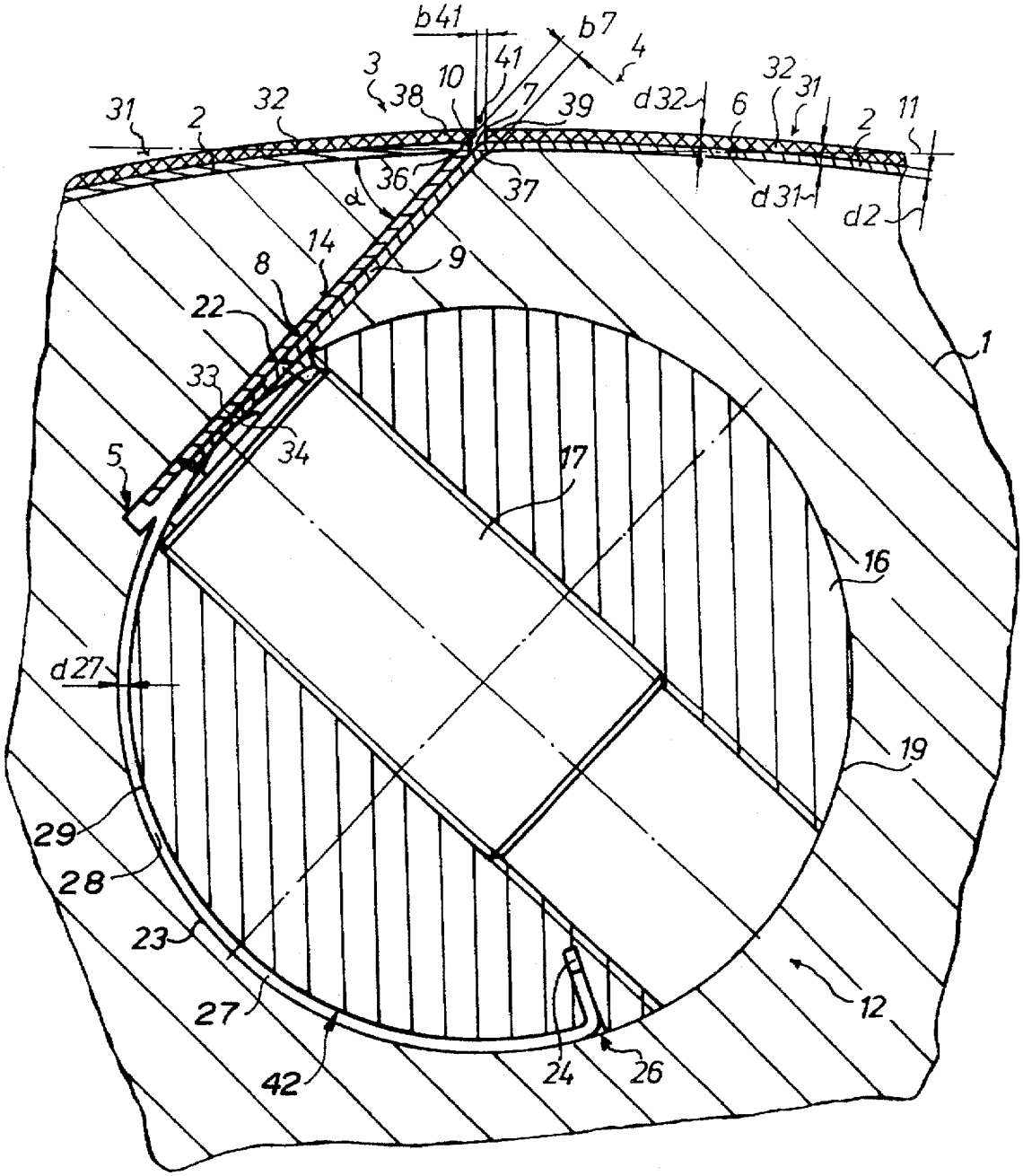
FIG. 2 is a view generally similar to FIG. 1 and showing the device in the clamping position.
Figure 3:
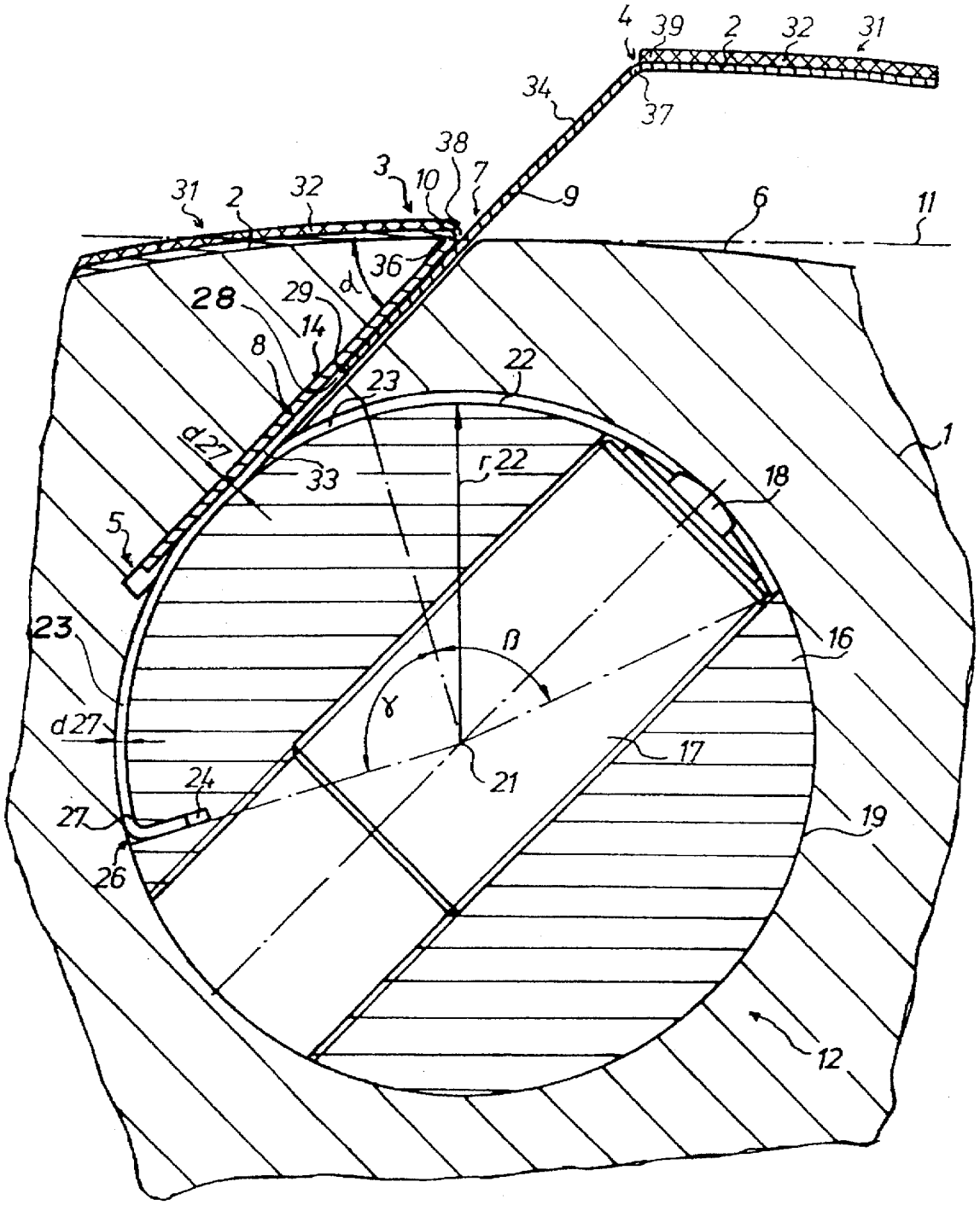
FIG. 3 is a view generally similar to FIGS. 1 and 2 and showing the device in the lifting position.

Referring initially to FIG. 1, and also referring to FIGS. 2 and 3, there may be seen at 1 a portion of a blanket cylinder which is a part of a rotary printing press and in which the device for fastening a rubber blanket unit in accordance with the present invention is situated. It will be understood that cylinder 1 is a blanket cylinder that forms part of a rotary printing press. Cylinder 1 could also be a plate cylinder or another type of cylinder which is utilized in a rotary printing press. The overall structure of the cylinder 1 and of the rotary printing press form no part of the subject invention and are thus not described in detail.

Cylinder 1 is structured to receive flexible rubber blanket units 31 on its surface 6 and is provided with at least one axially extending, generally radially directed thin slit 7 that extends generally inwardly into the interior 5 of cylinder 1 from a slit outer end 10 at the surface 6 of the cylinder 1. The flexible rubber blanket unit 31, that is situated on the surface 6 of the cylinder 1, is provided with leading and trailing ends 3 and 4, respectively. As may be seen in FIGS. 1–3, these leading and trailing ends 3 and 4 have leading and trailing beveled support plate end legs 8 and 9, respectively which are receivable in narrow slit 7 when flexible blanket unit 31 is positioned on the surface 6 of the cylinder 1.

The rubber blanket unit 31 has a thickness d31 of, for example, d31=2.2 mm. Rubber blanket unit 31 consists essentially of a generally dimensionally stable, flexible support plate 2, which is, for example, a metal plate having a plate thickness d2 of, for example, d2=0.3 mm. A rubber blanket 32, with a blanket thickness d32 of, for example, d32=1.9 mm is secured to the support plate 2 by being glued or vulcanized thereto.

In the present invention, the leading end of the support plate 2 of the rubber blanket unit 31 has a leading beveled end leg 8 while the trailing end of the rubber blanket unit 31 of the support plate 2 has a trailing beveled end leg 9. In the support plate 2 depicted in the drawings, the leading end leg 8 is longer than the trailing end leg 9 of the plate 2. The rubber blanket 32 is fastened on the support plate 2 in such a way that the beveled leading and trailing end legs 8 and 9, respectively, of the support plate 2 are unencumbered by the rubber blanket 32 at the ends 3 and 4 of the rubber blanket ;unit 31. Only the two beveled end legs 8 and 9 of the support plate 2 extend into the slit 7.

As may be seen in FIGS. 1–3, the narrow slit 7 is preferably generally rectangular in cross-section. The cylinder slit 7 has a width b7 at its outer end 10 which is slightly greater than twice the thickness d2 of the support plate 2. Thus b7=1 mm, for example. The slit 7 is inclined at an angle of inclination $\alpha$ of generally 45° with respect to a line 11 which is tangent to the surface 6 of the cylinder 1 at the location of the slit 7.

An axially extending bore 12 is formed in the cylinder 1 and extends parallel with the cylinder slit 7. An inner portion of the slit 7 is in contact with the bore 12 and forms a chord with respect to the bore 12. In the subject invention, there is a virtual continuation of a surface area 13 of the bore 12 at a distance "a" in respect to a lateral face 14 of the slit 7 facing away from the bore 12. This distance "a" is slightly greater than the thickness d2 of the support plate 2. For example, a=0.4 mm.

A pivot lever 16 which, in the subject invention, is configured as a spindle 16 having a radius r16, for example, r16=15 mm, is seated in the bore 12. The pivot lever or spindle 16 is centered in the cylinder bore 12 and is rotatable with respect to the cylinder 1 in the bore 12. A plurality of radially outwardly acting pressure elements, generally at 17, are axially spaced along the length of the spindle 16. These pressure elements 17 are secured in the spindle 16 in such a way that pressure cams 18, which are part of the pressure elements 17, can resiliently act or extend radially outwardly beyond a circumferential surface 19 of the spindle 16. Each of these pressure cams 18 may be provided with a ball or a generally rounded end cap at its radially outer end. Other end shapes, such as cylinder segments, are also possible. Each pressure cam 18 forms a contact zone, which may be, for example, linear with the inner surface of the plate end leg 9 which it contacts, as seen in FIG. 2.

As may be seen in each of FIGS. 1, 2 and 3, the circumferential surface 19 of the spindle 16 is discontinuous about it circumferential length. In the area of radially outwardly acting pressure elements 17, the surface area 19 of the spindle 16 has a first, continuous surface area portion 22 of a reduced radius r22 in which r22=14.5 mm. This continuous reduced radius surface area portion 22 has a arcuate length $\beta$ of generally 80° with respect to a longitudinal axis 21 of the spindle 16. This is followed, as may be seen in the drawings, by a second, discontinuous reduced diameter portion 42 extending over an angle $\gamma$ of generally 90° in which this second, discontinuous reduced surface area 42, viewed in the axial direction of the spindle 16, is provided in the form of a plurality of axially spaced generally U-shaped grooves 23 which each extend in the circumferential direction of the spindle 16. Thus the reduced diameter portion of the spindle 16 has a first continuously reduced diameter portion 22 and a second discontinuous reduced diameter portion 42. This second, discontinuous reduce diameter portion 42, that is formed by the plurality of U-shaped grooves 23, terminates in an axially extending spindle surface channel or slot 24 that is cut into spindle 16 and which extends radially inwardly into the spindle 16 from its surface 19.

A resilient ejector 27 is situated in each of the U-shaped grooves 23 formed in the spindle 16. A first end 26 of each resilient ejector 27 is positioned in the spindle channel 24. These resilient ejectors 27 are made of a flexible, elastic but pressure resistant material and in the preferred embodiment are leaf springs made of spring steel. Each of these ejectors 27 has a length 127 of, for example, 127=25 mm. Each ejector is sized to be receivable in its cooperating U-shaped groove 23 on the discontinuous reduced diameter portion 42 of the spindle 16. The length 127 of each spindle is sufficient to bring a free second end 28 of each ejector 27 into the first, continuous reduced diameter portion 22 of the spindle 16. Each ejector 27 has a thickness d27 wherein d27=0.5 mm, for example.

The operation of this device for clamping a rubber blanket unit on a cylinder in accordance with the present invention will now be discussed in detail. With the cylinder 1 in a blanket end insertion position, as depicted in FIG. 1, the spindle 16 has been rotated so that the first, continuous reduced diameter portion 22 is generally adjacent the inner end of the cylinder slit 7. This situates the resilient ejectors 27 beneath or radially inwardly of the slit 7 and the pressure elements 17 out of contact with the cylinder slit 7. In this plate end insertion position, the two beveled end legs 8 and 9 of the ends 3 and 4 of the support plate 2 of the rubber blanket unit 31 can be inserted into the slit 7 with the continuous reduced area 22 of the spindle 16 acting as a guide. The two beveled end legs 8 and 9 of the support plate 2 of the rubber blanket unit 31 are matched to the angle of inclination $\alpha$ of the slot 7.

As the rubber blanket unit 31 is positioned on the peripheral surface 6 of the blanket cylinder 1, the end legs 8 and 9 of the beveled blanket support plate 2, which are inserted into the cylinder slit 7, and which do not have a rubber covering, will be placed directly in contact with each other. Their lateral outer sides or lateral outer faces 33 and 34 will be facing each other, as may be seen most clearly in FIGS. 1 and 2. The rubber blanket 32 of the rubber blanket unit 31 extends on the blanket support plate 2 as far as the leading and trailing ends 3 and 4 and thus extends as far as the slit 7 which interrupts the peripheral surface 6 of the blanket cylinder 1. This means that opposing leading and trailing edges 38 and 39 of the rubber blanket 32 will essentially abut each other and will be spaced circumferentially from each other by a very small gap 41 that has a gap width b41 of, for example b41=0.3 mm. In the arrangement depicted in the subject invention, as seen in FIG. 2, the leading edge 38 of the rubber blanket 32 is slightly drawn around the bevel 36 at the leading end 3 of the rubber blanket unit 31 but does not rest against, or contact the end leg 9 of the support plate 2 at the trailing end 4. The trailing edge 39 of the rubber blanket terminates at the bevel 37 at the trailing end 4 of the rubber blanket unit 31. As soon as the beveled end legs 8 and 9 of the ends 3 and 4 of the support plate 2 of the rubber blanket unit 31 have been fully inserted into the cylinder slit 7 and the flexible support plate 2 has been pressed against the surface 6 of the cylinder 1, the spindle 16 will be rotated in a counterclockwise direction into the clamping position which is depicted at FIG. 2. This counterclockwise rotation of the spindle 16 will locate the pressure elements 17 so that they are generally perpendicular with the support plate end legs 8 and 9 and so that their pressure cams 18 will bear against the inner surface of the beveled end leg 9 of the beveled support plate. These pressure cams 18 may be pressed against the plate end leg 9 by the force of suitable springs which are carried within the pressure elements, as is depicted in a somewhat schematic fashion in the drawings. This cooperation of the pressure elements 17 carried by the spindle 16, the pressure cams 18 which are part of the pressure elements, and the spring forces and the spring travel which urge the pressure cams 18 into clamping contact with the end leg 9 of the plate 2 is effective to securely clamp the rubber blanket unit 31 onto the surface of the cylinder 1. The end legs 8 and 9 of the support plate 2 of the rubber blanket unit 31 are clamped in the narrow slit 7 of the cylinder 1 by the action of the pressure cams 18 which stretch and pull the end legs 8 and 9 radially inwardly into the cylinder slit 7. Once the spindle 16 has been turned to the clamped position depicted in FIG. 2, it can be stopped and retained in that position.

When it is desired to release the support plate beveled end legs 8 and 9 of the rubber blanket unit 31 from the narrow slit 7, the spindle will be rotated in a clockwise direction into a plate and ejection position. As the spindle 16 is rotated in this clockwise direction, the pressure elements 17 will move out of contact with the end leg 9 of the blanket unit ends 3 and 4 to thus release the end legs 8 and 9. This rotation of the spindle 16 brings the pressure elements 17 into the portion of the cylinder bore 12 in which the pressure cams 18 engage the surface 13 of the cylinder bore 12. As the spindle 16 is continued to be rotated in the clockwise direction, the free ends 28 of the resilient ejector 27 will now reach the area of the trailing end leg 9 of the rubber blanket unit 31. A first face of each ejector free end 28 will abut a front face 29 of the leg 9 of the trailing end 4 and will exert a radially outwardly directed force against it. As the spindle 16 is continued to be rotated in a clockwise direction, the resilient ejectors 27 spring out of their U-shaped grooves 23 and extend radially upwardly into the narrow cylinder slit 7. This positions the free ends 28 of the ejectors generally tangentially with respect to the spindle 16 with the ejector free ends 28 extending toward the outer end 10 of the slit 7. The spindle 16 is rotated in its clockwise direction until the free end 28 of each of the resilient ejectors 27 is situated just beneath, but closely adjacent to the surface 6 of the blanket cylinder 1. This has the effect of completely removing the trailing end leg 9 of the trailing end 4 of the rubber blanket unit 31 from the narrow cylinder slit 7. The inherent resiliency of the rubber blanket unit 31 and its intrinsic tension will act to cause the trailing end leg 9 to spring out of the cylinder slit 7 once it has been moved to the ejection portion.

While the device for fastening a rubber blanket unit to a blanket cylinder in accordance with the present invention has been discussed hereinabove as utilizing pressure springs in the pressure elements 17 to urge the pressure cams 18 radially outwardly, it would also be possible to utilize pre-stressed leaf springs in place of the pressure elements 17 and pressure cams 18. Such pre-stressed leaf springs would be arranged in the circumferential direction of the clamping lever or spindle 16 and would extend radially outwardly beyond the surface area 19 of the spindle 16.

While a preferred embodiment of a device for fastening a rubber blanket unit to a blanket cylinder in accordance with the present invention has been set forth fully and completely hereinabove, it will be apparent to one of skill in the art that a number of changes in, for example, the overall size of the cylinder, the type of printing being done by the printing press, the drive for the press and the like could be made without departing from the true spirit and scope of the present invention which is accordingly to be limited only by the following claims.

What is claimed is:

1. In a rotary printing press, the combination comprising:

a blanket cylinder;

a narrow, axially extending, generally radially inwardly directed slit formed on a peripheral surface of said blanket cylinder and extending inwardly into said cylinder from an outer surface of said cylinder, said slit being generally rectangular in cross-section and having a slit width;

a flexible rubber blanket unit having leading and trailing ends, said rubber blanket unit further having a rubber blanket fastened on an underlying support plate, said rubber blanket having a leading edge and a trailing edge, said support plate having a support plate thickness with a leading beveled end leg and a trailing beveled end leg, said support plate leading and trailing beveled end legs projecting past said blanket leading and trailing edges, each of said support plate leading and trailing beveled end legs having an inner face and an outer face, said support plate leading and trailing beveled end legs being insertable in said slit with said outer faces of said support plate leading and trailing beveled end legs being in direct contact with each other, and with said rubber blanket leading and trailing edges essentially abutting each other when said support plate leading and trailing beveled end legs are inserted in said slit, said slit width being uniformly slightly greater than twice said support plate thickness, said support plate leading and trailing beveled end legs filling said slit when said legs are inserted in said slit;

a rotatable pivot spindle supported in said blanket cylinder adjacent said cylinder slit for rotation about a longitudinal axis generally parallel to an axis of rotation of said blanket cylinder, said rotatable pivot spindle being rotatable between a support plate end leg insertion position and a support plate end leg clamped position; and a plurality of pressure cams disposed axially spaced along said pivot spindle adjacent said slit, each of said pressure cams being individually spring-mounted, said plurality of pressure cams each directly contacting said inner face of one of said support plate leading and trailing beveled end legs generally perpendicularly to said inner and outer faces with a spring force, said spring forces of said pressure cams clamping said support plate leading and trailing beveled end legs in said narrow cylinder slit when said rotatable pivot spindle is in said support plate end leg clamped position.

* * * * *